US011932913B2

(12) United States Patent
Ott et al.

(10) Patent No.: US 11,932,913 B2
(45) **Date of Patent: *Mar. 19, 2024**

(54) CAST IRON INOCULANT AND METHOD FOR PRODUCTION OF CAST IRON INOCULANT

(71) Applicant: ELKEM ASA, Oslo (NO)

(72) Inventors: Emmanuelle Ott, Oslo (NO); Oddvar Knustad, Kristiansand (NO)

(73) Assignee: ELKEM ASA, Oslo (NO)

( * ) Notice: Subject to any disclaimer, the term of this patent is extended or adjusted under 35 U.S.C. 154(b) by 116 days.

This patent is subject to a terminal disclaimer.

(21) Appl. No.: 16/957,283

(22) PCT Filed: Dec. 21, 2018

(86) PCT No.: PCT/NO2018/050324

§ 371 (c)(1),
(2) Date: Jun. 23, 2020

(87) PCT Pub. No.: WO2019/132668

PCT Pub. Date: Jul. 4, 2019

(65) Prior Publication Data

US 2020/0407811 A1 Dec. 31, 2020

(30) Foreign Application Priority Data

Dec. 29, 2017 (NO) ..... 20172061

(51) Int. Cl.
*C21C 1/10* (2006.01)
*C22C 33/00* (2006.01)
(Continued)

(52) U.S. Cl.
CPC ..... *C21C 1/105* (2013.01); *C22C 33/006* (2013.01); *C22C 33/08* (2013.01); *C22C 35/005* (2013.01);
(Continued)

(58) Field of Classification Search
None
See application file for complete search history.

(56) References Cited

U.S. PATENT DOCUMENTS 4,432,793 A 2/1984 Hilaire et al.
11,486,012 B2 * 11/2022 Ott ..... C22C 38/14
(Continued)

FOREIGN PATENT DOCUMENTS

BR 112018077282 A2 4/2019
CN 1281513 A 1/2001
(Continued)

OTHER PUBLICATIONS

Hiroshi, Effect of Bismuth on Nodule Count in Spheroidal Graphite Iron Castings with Thin Section. (Year: 1988).*
(Continued)

*Primary Examiner* — Xiaowei Su
(74) *Attorney, Agent, or Firm* — LUCAS & MERCANTI, LLP

(57) ABSTRACT

An inoculant for the manufacture of cast iron with spheroidal graphite is disclosed, the inoculant has a particulate ferrosilicon alloy having between 40 and 80% by weight of Si;
0.02-8% by weight of Ca;
0-5% by weight of Sr;
0-12% by weight of Ba;
0-15% by weight of rare earth metal;
0-5% by weight of Mg;
0.05-5% by weight of Al;
0-10% by weight of Mn;
0-10% by weight of Ti;
0-10 by weight of Zr;
the balance being Fe and incidental impurities in the ordinary amount, (Continued)

wherein the inoculant additionally contains, by weight, based on the total weight of inoculant: 0.1 to 15% of particulate $Bi_2S_3$, and optionally between 0.1 and 15% of particulate $Bi_2O_3$, and/or between 0.1 and 15% of particulate $Sb_2O_3$, and/or between 0.1 and 15% of particulate $Sb_2S_3$, and/or between 0.1 and 5% of particulate $Fe_3O_4$, $Fe_2O_3$, FeO, or a mixture thereof, and/or between 0.1 and 5% of one or more of particulate FeS, $FeS_2$, $Fe_3S_4$, or a mixture thereof, a method for producing such inoculant and use of such inoculant.

21 Claims, 4 Drawing Sheets

(51) Int. Cl.

| | |
|---|---|
| ***C22C 33/08*** | (2006.01) |
| ***C22C 35/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/60*** | (2006.01) |

(52) U.S. Cl.
CPC ..... *C22C 38/002* (2013.01); *C22C 38/005* (2013.01); *C22C 38/02* (2013.01); *C22C 38/04* (2013.01); *C22C 38/06* (2013.01); *C22C 38/14* (2013.01); *C22C 38/60* (2013.01)

(56) References Cited

U.S. PATENT DOCUMENTS

| | | | | |
|---|---|---|---|---|
| 11,708,618 | B2 * | 7/2023 | Ott | B22D 1/007 164/57.1 |
| 2015/0284830 | A1 | 10/2015 | Fay et al. | |
| 2016/0047008 | A1 | 2/2016 | Margaria et al. | |
| 2020/0399724 | A1 * | 12/2020 | Ott | C22C 38/14 |
| 2020/0399726 | A1 * | 12/2020 | Ott | C22C 38/005 |

FOREIGN PATENT DOCUMENTS

| | | | |
|---|---|---|---|
| CN | 1665941 | A | 9/2005 |
| CN | 1687464 | A | 10/2005 |
| CN | 1718819 | A | 1/2006 |
| CN | 1833041 | A | 9/2006 |
| CN | 101381793 | A | 3/2009 |
| CN | 101525719 | A | 9/2009 |
| CN | 102002548 | A | 4/2011 |
| CN | 103418757 | A | 12/2013 |
| CN | 103484749 | A | 1/2014 |
| CN | 103898268 | B | 8/2015 |
| CN | 105401049 | A | 3/2016 |
| CN | 105950953 | A | 9/2016 |
| CN | 106834588 | A | 6/2017 |
| CN | 107354370 | A | 11/2017 |
| CN | 107400750 | A | 11/2017 |
| CN | 107829017 | A | 3/2018 |
| EP | 1126037 | A1 | 8/2001 |
| EP | 1639145 | B1 | 8/2010 |
| GB | 1296048 | A | 11/1972 |
| JP | S5943843 | A | 3/1984 |
| SU | 872563 | A1 | 10/1981 |
| SU | 1047969 | A1 | 10/1983 |
| SU | 1079684 | A1 | 3/1984 |
| SU | 1186682 | A1 | 10/1985 |
| WO | 9524508 | A1 | 9/1995 |
| WO | 9920011 | A1 | 4/1999 |
| WO | 9929911 | A1 | 6/1999 |
| WO | 02081758 | A1 | 10/2002 |
| WO | 2006068487 | A1 | 6/2006 |
| WO | 2018004356 | A1 | 1/2018 |

OTHER PUBLICATIONS

Machine translation of JP 107400750A. (Year: 2017).*
Search Report for Corresponding Chinese Application No. 201880083902.2 dated Jul. 19, 2021; 4 Pages.
Search Report for Corresponding Russian Application No. 2020124956 (2 Pages) (dated Jul. 6, 2021).
Search Report for Corresponding Norwegian Application No. 20172061 (2 Pages) (dated Jul. 20, 2018).
International Search Report and Written Opinion for Corresponding International Application No. PCT/NO2018/050324 (11 Pages) (dated Apr. 4, 2019).
International Search Report and Written Opinion for Corresponding International Application No. PCT/NO2018/050327 (10 Pages) (dated Apr. 17, 2019).
Search Report for Corresponding Norwegian Application No. 20172064(2 Pages) (dated Jul. 20, 2018).
Search Report for Corresponding Taiwanese Application No. 107147351 (1 Page) (dated Oct. 15, 2019).
International Preliminary Report on Patentability for Corresponding International Application No. PCT/NO2018/050327 (16 Pages) (dated Dec. 4, 2019).
International Search Report and Written Opinion for Corresponding International Application No. PCT/NO2018/050325 (9 Pages) (dated Apr. 15, 2019).
Search Report for Corresponding Norwegian Application No. 20172062 (2 Pages) (dated Jul. 20, 2018).
Search Report for Corresponding Taiwanese Application No. 107147349 (1 Page) ( dated Aug. 1, 2019).
International Search Report and Written Opinion for Corresponding International Application No. PCT/NO2018/050326 (10 Pages) (dated Apr. 26, 2019).
Search Report for Corresponding Norwegian Application No. 20172063 (2 Pages) (dated Jul. 20, 2018).
Search Report for Corresponding Taiwanese Application No. 107147350 (1Page) (dated Oct. 15, 2019).
Search Report for Corresponding Norwegian Application No. 20172065 (2 Pages) (dated Jul. 20, 2018).
Search Report for Corresponding Taiwanese Application No. 107147348 (1 Page) (dated Oct. 15, 2019).
International Search Report and Written Opinion for Corresponding International Application No. PCT/NO2018/050328 (10 Pages) (dated Apr. 26, 2019).
Office Action for Corresponding Indian Application No. 202017023902 dated Oct. 5, 2021 and English translation; 6 Pages.
Search Report for corresponding Brazilian Application No. BR112020012539-3 dated Jul. 4, 2022, 4 Pages.

* cited by examiner

CAST IRON INOCULANT AND METHOD FOR PRODUCTION OF CAST IRON INOCULANT

CROSS REFERENCE TO RELATED APPLICATION

This Application is a 371 of PCT/N02018/050324 filed on Dec. 21, 2018 which, in turn, claimed the priority of Norwegian Patent Application No. 20172061 filed on Dec. 29, 2017, both applications are incorporated herein by reference.

TECHNICAL FIELD

The present invention relates to a ferrosilicon based inoculant for the manufacture of cast iron with spheroidal graphite and to a method for production of the inoculant.

BACKGROUND ART

Cast iron is typically produced in cupola or induction furnaces, and generally contain between 2 to 4 percent carbon. The carbon is intimately mixed with the iron and the form which the carbon takes in the solidified cast iron is very important to the characteristics and properties of the iron castings. If the carbon takes the form of iron carbide, then the cast iron is referred to as white cast iron and has the physical characteristics of being hard and brittle, which in most applications is undesirable. If the carbon takes the form of graphite, the cast iron is soft and machinable.

Graphite may occur in cast iron in the lamellar, compacted or spheroidal forms. The spheroidal shape produces the highest strength and most ductile type of cast iron.

The form that the graphite takes as well as the amount of graphite versus iron carbide, can be controlled with certain additives that promote the formation of graphite during the solidification of cast iron. These additives are referred to as nodularisers and inoculants and their addition to the cast iron as nodularisation and inoculation, respectively. In cast iron production iron carbide formation especially in thin sections is often a challenge. The formation of iron carbide is brought about by the rapid cooling of the thin sections as compared to the slower cooling of the thicker sections of the casting. The formation of iron carbide in a cast iron product is referred to in the trade as "chill". The formation of chill is quantified by measuring "chill depth" and the power of an inoculant to prevent chill and reduce chill depth is a convenient way in which to measure and compare the power of inoculants, especially in grey irons. In nodular iron, the power of inoculants is usually measured and compared using the graphite nodule number density.

As the industry develops there is a need for stronger materials. This means more alloying with carbide promoting elements such as Cr, Mn, V, Mo, etc., and thinner casting sections and lighter design of castings. There is therefore a constant need to develop inoculants that reduce chill depth and improve machinability of grey cast irons as well as increase the number density of graphite spheroids in ductile cast irons. The exact chemistry and mechanism of inoculation and why inoculants function as they do in different cast iron melts is not completely understood, therefore a great deal of research goes into providing the industry with new and improved inoculants.

It is thought that calcium and certain other elements suppress the formation of iron carbide and promote the formation of graphite. A majority of inoculants contain calcium. The addition of these iron carbide suppressants is usually facilitated by the addition of a ferrosilicon alloy and probably the most widely used ferrosilicon alloys are the high silicon alloys containing 70 to 80% silicon and the low silicon alloy containing to 55% silicon. Elements which commonly may be present in inoculants, and added to the cast iron as a ferrosilicon alloy to stimulate the nucleation of graphite in cast iron, are e.g. Ca, Ba, Sr, Al, rare earth metals (RE), Mg, Mn, Bi, Sb, Zr and Ti.

The suppression of carbide formation is associated by the nucleating properties of the inoculant. By nucleating properties it is understood the number of nuclei formed by an inoculant. A high number of nuclei formed results in an increased graphite nodule number density and thus improves the inoculation effectiveness and improves the carbide suppression. Further, a high nucleation rate may also give better resistance to fading of the inoculating effect during prolonged holding time of the molten iron after inoculation. Fading of inoculation can be explained by the coalescing and re-solution of the nuclei population which causes the total number of potential nucleation sites to be reduced.

U.S. Pat. No. 4,432,793 discloses an inoculant containing bismuth, lead and/or antimony. Bismuth, lead and/or antimony are known to have high inoculating power and to provide an increase in the number of nuclei. These elements are also known to be anti-spheroidizing elements, and the increasing presence of these elements in cast iron is known to cause degeneration of the spheroidal graphite structure. The inoculant according to U.S. Pat. No. 4,432,793 is a ferrosilicon alloy containing from 0.005% to 3% rare earths and from 0.005% to 3% of one of the metallic elements bismuth, lead and/or antimony alloyed in the ferrosilicon.

According to U.S. Pat. No. 5,733,502 the inoculants according to the said U.S. Pat. No. 4,432,793 always contain some calcium which improves the bismuth, lead and/or antimony yield at the time the alloy is produced and helping to distribute these elements homogeneously within the alloy, as these elements exhibit poor solubility in the iron-silicon phases. However, during storage the product tends to disintegrate and the granulometry tends toward an increased amount of fines. The reduction of granulometry was linked to the disintegration, caused by atmospheric moisture, of a calcium-bismuth phase collected at the grain boundaries of the inoculants. In U.S. Pat. No. 5,733,502 it was found that the binary bismuth-magnesium phases, as well as the ternary bismuth-magnesium-calcium phases, were not attacked by water. This result was only achieved for high silicon ferrosilicon alloy inoculants, for low silicon FeSi inoculants the product disintegrated during storage. The ferrosilicon-based alloy for inoculation according to U.S. Pat. No. 5,733,502 thus contains (by weight %) from 0.005-3% rare earths, 0.005-3% bismuth, lead and/or antimony, 0.3-3% calcium and 0.3-3% magnesium, wherein the Si/Fe ratio is greater than 2.

U.S. patent application No. 2015/0284830 relates to an inoculant alloy for treating thick cast-iron parts, containing between 0.005 and 3 wt % of rare earths and between 0.2 and 2 wt % Sb. Said US 2015/0284830 discovered that antimony, when allied to rare earths in a ferrosilicon-based alloy, would allow an effective inoculation, and with the spheroids stabilized, of thick parts without the drawbacks of pure antimony addition to the liquid cast-iron. The inoculant according to US 2015/0284830 is described to be typically used in the context of an inoculation of a cast-iron bath, for pre-conditioning said cast-iron as well as a nodularizer treatment. An inoculant according to US 2015/0284830 contains (by wt %) 65% Si, 1.76% Ca, 1.23% A1, 0.15% Sb, 0.16% RE, 7.9% Ba and balance iron.

From WO 95/24508 it is known a cast iron inoculant showing an increased nucleation rate. This inoculant is a ferrosilicon based inoculant containing calcium and/or strontium and/or barium, less than 4% aluminium and between 0.5 and 10% oxygen in the form of one or more metal oxides. It was, however found that the reproducibility of the number of nuclei formed using the inoculant according to WO 95/24508 was rather low. In some instances a high number of nuclei are formed in the cast iron, but in other instances the numbers of nuclei formed are rather low. The inoculant according to WO 95/24508 has for the above reason found little use in practice.

From WO 99/29911 it is known that the addition of sulphur to the inoculant of WO 95/24508 has a positive effect in the inoculation of cast iron and increases the reproducibility of nuclei.

In WO 95/24508 and WO 99/29911 iron oxides, FeO, $Fe_2O_3$ and $Fe_3O_4$, are the preferred metal oxides. Other metal oxides mentioned in these patent applications are $SiO_2$, MnO, MgO, CaO, $Al_2O_3$, $TiO_2$ and $CaSiO_3$, $CeO_2$, $ZrO_2$. The preferred metal sulphide is selected from the group consisting of FeS, $FeS_2$, MnS, MgS, CaS and CuS.

From US application No. 2016/0047008 it is known a particulate inoculant for treating liquid cast-iron, comprising, on the one hand, support particles made of a fusible material in the liquid cast-iron, and on the other hand, surface particles made of a material that promotes the germination and the growth of graphite, disposed and distributed in a discontinuous manner at the surface of the support particles, the surface particles presenting a grain size distribution such that their diameter d50 is smaller than or equal to one-tenth of the diameter d50 of the support particles. The purpose of the inoculant in said US 2016' is inter alia indicated for the inoculation of cast-iron parts with different thicknesses and low sensibility to the basic composition of the cast-iron.

Thus, there is a desire to provide an inoculant having improved nucleating properties and forming a high number of nuclei, which results in an increased graphite nodule number density and thus improves the inoculation effectiveness. Another desire is to provide a high performance inoculant. A further desire is to provide an inoculant which may give better resistance to fading of the inoculating effect during prolonged holding time of the molten iron after inoculation. Another desire is to provide a FeSi based inoculant containing bismuth, having a high bismuth yield in the production of the inoculant compared to the bismuth alloyed inoculants of the prior art. At least some of the above desires are met with the present invention, as well as other advantages, which will become evident in the following description.

SUMMARY OF INVENTION

The prior art inoculant according to WO 99/29911 is considered to be a high performance inoculant, which gives a high number of nodules in ductile cast iron. It has now been found that the addition of bismuth sulphide to the inoculant of WO 99/29911 surprisingly results in a significantly higher number of nuclei, or nodule number density, in cast irons when adding the inoculant containing bismuth sulphide to cast iron.

In a first aspect, the present invention relates to an inoculant for the manufacture of cast iron with spheroidal graphite, where said inoculant comprises a particulate ferrosilicon alloy consisting of between 40 and 80% by weight of Si; 0.02-8% by weight of Ca; 0-5% by weight of Sr; 0-12% by weight of Ba; 0-15% by weight of rare earth metal; 0-5% by weight of Mg; 0.05-5% by weight of Al; 0-10% by weight of Mn; 0-10% by weight of Ti; 0-10% by weight of Zr; the balance being Fe and incidental impurities in the ordinary amount, and where said inoculant additionally contains, by weight, based on the total weight of inoculant: 0.1 to 15% of particulate $Bi_2S_3$, and optionally between 0.1 and 15% of particulate $Bi_2O_3$, and/or between 0.1 and 15% of particulate $Sb_2O_3$, and/or between 0.1 and 15% of particulate $Sb_2S_3$, and/or between 0.1 and 5% of one or more of particulate $Fe_3O_4$, $Fe_2O_3$, FeO, or a mixture thereof, and/or between 0.1 and 5% of one or more of particulate FeS, $FeS_2$, $Fe_3S_4$, or a mixture thereof In an embodiment, the ferrosilicon alloy comprises between 45 and 60% by weight of Si. In another embodiment of the inoculant the ferrosilicon alloy comprises between 60 and 80% by weight of Si.

In an embodiment, the rare earth metals include Ce, La, Y and/or mischmetal. In an embodiment, the ferrosilicon alloy comprises up to 10% by weight of rare earth metal.

In an embodiment, the ferrosilicon alloy comprises between 0.5 and 3% by weight of Ca. In an embodiment, the ferrosilicon alloy comprises between 0 and 3% by weight of Sr. In a further embodiment, the ferrosilicon alloy comprises between 0.2 and 3% by weight of Sr. In an embodiment, the ferrosilicon alloy comprises between 0 and 5% by weight of Ba. In a further embodiment, the ferrosilicon alloy comprises between 0.1 and 5% by weight of Ba. In an embodiment, the ferrosilicon alloy comprises between 0.5 and 5% by weight Al. In an embodiment, the ferrosilicon alloy comprises up to 6% by weight of Mn and/or Ti and/or Zr. In an embodiment, the ferrosilicon alloy comprises less than 1% by weight Mg.

In an embodiment, the inoculant comprises between 0.5 and 10% by weight of particulate $Bi_2S_3$.

In an embodiment, the inoculant comprises between 0.1 and 10% of particulate $Bi_2O_3$.

In an embodiment, the inoculant comprises between 0.1 and 8% of particulate $Sb_2O_3$.

In an embodiment, the inoculant comprises between 0.1 and 8% of particulate $Sb_2S_3$.

In an embodiment, the inoculant comprises between 0.5 and 3% of one or more of particulate $Fe_3O_4$, $Fe_2O_3$, FeO, or a mixture thereof, and/or between 0.5 and 3% of one or more of particulate FeS, $FeS_2$, $Fe_3S_4$, or a mixture thereof.

In an embodiment, the total amount (sum of sulphide/oxide compounds) of the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, is up to 20% by weight, based on the total weight of the inoculant. In another embodiment the total amount of particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, is up to 15% by weight, based on the total weight of the inoculant.

In an embodiment, the inoculant is in the form of a blend or a mechanical/physical mixture of the particulate ferrosilicon alloy and the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof.

In an embodiment, the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, is/are present as coating compounds on the particulate ferrosilicon based alloy.

In an embodiment, the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, is/are mechanically mixed or blended with the particulate ferrosilicon based alloy, in the presence of a binder.

In an embodiment, the inoculant is in the form of agglomerates made from a mixture of the particulate ferrosilicon alloy and the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof, in the presence of a binder.

In an embodiment, the inoculant is in the form of briquettes made from a mixture of the particulate ferrosilicon alloy and the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof, in the presence of a binder.

In an embodiment, the particulate ferrosilicon based alloy and the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof, are added separately but simultaneously to liquid cast iron.

In a second aspect the present invention relates to a method for producing an inoculant according to the present invention, the method comprises: providing a particulate base alloy comprising between 40 and 80% by weight of Si, 0.02-8% by weight of Ca; 0-5% by weight of Sr; 0-12% by weight of Ba; 0-15% by weight of rare earth metal; 0-5% by weight of Mg; 0.05-5% by weight of Al; 0-10% by weight of Mn; 0-10% by weight of Ti; 0-10% by weight of Zr; the balance being Fe and incidental impurities in the ordinary amount, and adding to the said particulate base, by weight, based on the total weight of inoculant: 0.1 to 15% of particulate $Bi_2S_3$, and optionally between 0.1 and 15% of particulate $Bi_2O_3$, and/or between 0.1 and 15% of particulate $Sb_2O_3$, and/or between 0.1 and 15% of particulate $Sb_2S_3$, and/or between 0.1 and 5% of one or more of particulate $Fe_3O_4$, $Fe_2O_3$, FeO, or a mixture thereof, and/or between 0.1 and 5% of one or more of particulate FeS, $FeS_2$, $Fe_3S_4$, or a mixture thereof, to produce said inoculant.

In an embodiment of the method the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof, if present, are mechanically mixed or blended with the particulate base alloy.

In an embodiment of the method the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof, if present, are mechanically mixed before being mixed with the particulate base alloy.

In an embodiment of the method, the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more particulate FeS, $FeS_2$, $Fe_3S_4$, or a mixture thereof, if present, are mechanically mixed or blended with the particulate base alloy in the presence of a binder. In a further embodiment of the method, the mechanically mixed or blended particulate base alloy, the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof, if present, in the presence of a binder, are further formed into agglomerates or briquettes.

In another aspect, the present invention related to the use of the inoculant as defined above in the manufacturing of cast iron with spheroidal graphite, by adding the inoculant to the cast iron melt prior to casting, as an in-mould inoculant or simultaneously to casting.

In an embodiment of the use of the inoculant the particulate ferrosilicon based alloy and the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof, are added as a mechanical/physical mixture or a blend to the cast iron melt.

In an embodiment of the use of the inoculant the particulate ferrosilicon based alloy and the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof, are added separately but simultaneously to the cast iron melt.

DETAILED DESCRIPTION OF THE INVENTION

Figure 1:
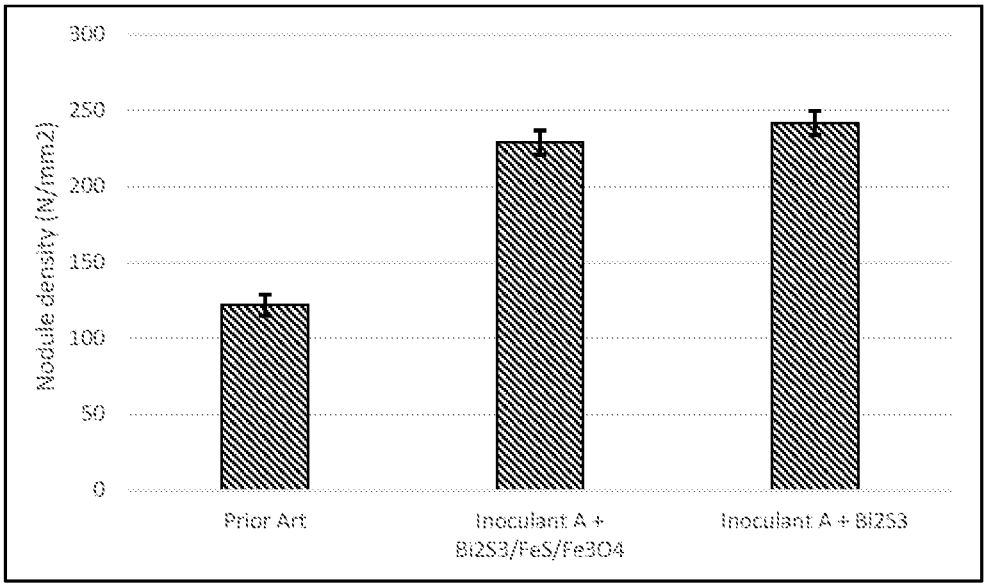
FIG. 1: diagram showing nodule number density (nodule number per $mm^2$, abbreviated $N/mm^2$) in cast iron samples of Melt E in example 1.

According to the present invention a high potent inoculant is provided, for the manufacture of cast iron with spheroidal graphite. The inoculant comprises a FeSi base alloy combined with particulate bismuth sulphide ($Bi_2S_3$), and optionally also comprising other particulate metal oxides and/or particulate metal sulphides chosen from; bismuth oxide ($Bi_2O_3$), antimony sulphide ($Sb_2S_3$), antimony oxide ($Sb_2O_3$), iron oxide (one or more of $Fe_3O_4$, $Fe_2O_3$, FeO, or a mixture thereof) and iron sulphide (one or more of FeS, $FeS_2$, $Fe_3S_4$, or a mixture thereof). The inoculant according to the present invention is easy to manufacture and it is easy to control and vary the amount of bismuth and antimony in the inoculant. Complicated and costly alloying steps are avoided, thus the inoculant can be manufactured at a lower cost compared to prior art inoculants containing Bi and/or Sb.

In the manufacturing process for producing ductile cast iron with spheroidal graphite the cast iron melt is normally treated with a nodulariser, e.g. by using an MgFeSi alloy, prior to the inoculation treatment. The nodularisation treatment has the objective to change the form of the graphite from flake to nodule when it is precipitating and subsequently growing. The way this is done is by changing the interface energy of the interface graphite/melt. It is known that Mg and Ce are elements that change the interface energy, Mg being more effective than Ce. When Mg is added to a base iron melt, it will first react with oxygen and sulphur, and it is only the "free magnesium" that will have a nodularising effect. The nodularisation reaction is violent and results in agitation of the melt, and it generates slag floating on the surface. The violence of the reaction will result in most of the nucleation sites for graphite that were already in the melt (introduced by the raw materials) and other inclusions being part of the slag on the top and removed. However some MgO and MgS inclusions produced during the nodularisation treatment will still be in the melt. These inclusions are not good nucleation sites as such.

The primary function of inoculation is to prevent carbide formation by introducing nucleation sites for graphite. In addition to introducing nucleation sites the inoculation also transform the MgO and MgS inclusions formed during the nodularisation treatment into nucleation sites by adding a layer (with Ca, Ba or Sr) on the inclusions.

In accordance with the present invention, the particulate FeSi base alloys should comprise from 40 to 80% by weight Si. Pure FeSi alloys are a week inoculant, but is a common alloy carrier for active elements, allowing good dispersion in the melt. Thus, there exist a variety of known FeSi alloy compositions for inoculants. Conventional alloying elements in a FeSi alloy inoculant include Ca, Ba, Sr, Al, Mg, Zr, Mn, Ti and RE (especially Ce and La). The amount of the alloying elements may vary. Normally inoculants are designed to serve different requirements in grey, compacted and ductile iron production. The inoculant according to the present invention may comprise a FeSi base alloy with a silicon content of about 40-80% by weight. The alloying elements may comprise about 0.02-8% by weight of Ca; about 0-5% by weight of Sr; about 0-12% by weight of Ba; about 0-15% by weight of rare earth metal; about 0-5% by weight of Mg; about 0.05-5% by weight of Al; about 0-10% by weight of Mn; about 0-10% by weight of Ti; about 0-10% by weight of Zr; and the balance being Fe and incidental impurities in the ordinary amount.

The FeSi base alloy may be a high silicon alloy containing 60 to 80% silicon or a low silicon alloy containing 45 to 60% silicon. Silicon is normally present in cast iron alloys, and is a graphite stabilizing element in the cast iron, which forces carbon out of the solution and promotes the formation of graphite. The FeSi base alloy should have a particle size lying within the conventional range for inoculants, e.g. between 0.2 to 6 mm. It should be noted that smaller particle sizes, such as fines, of the FeSi alloy may also be applied in the present invention, to manufacture the inoculant. When using very small particles of the FeSi base alloy the inoculant may be in the form of agglomerates (e.g. granules) or briquettes. In order to prepare agglomerates and/or briquettes of the present inoculant, the $Bi_2S_3$ particles, and any additional particulate $Bi_2O_3$ and/or $Sb_2O_3$, and/or one or more of $Fe_3O_4$, $Fe_2O_3$, FeO, or a mixture thereof, and/or one or more of FeS, $FeS_2$, $Fe_3S_4$, or a mixture thereof, are mixed with the particulate ferrosilicon alloy by mechanical mixing or blending, in the presence of a binder, followed by agglomeration of the powder mixture according to the known methods. The binder may e.g. be a sodium silicate solution. The agglomerates may be granules with suitable product sizes, or may be crushed and screened to the required final product sizing.

A variety of different inclusions (sulphides, oxides, nitrides and silicates) can form in the liquid state. The sulphides and oxides of the group IIA-elements (Mg, Ca, Sr and Ba) have very similar crystalline phases and high melting points. The group IIA-elements are known to form stable oxides in liquid iron; therefore inoculants, and nodularisers, based on these elements are known to be effective deoxidizers. Calcium is the most common trace element in ferrosilicon inoculants. In accordance with the invention, the particulate FeSi based alloy comprises between about 0.02 to about 8% by weight of calcium. In some applications it is desired to have low content of Ca in the FeSi base alloy, e.g. from 0.02 to 0.5% by weigh. Compared to conventional inoculant ferrosilicon alloys containing alloyed bismuth, where calcium is regarded as a necessary element to improve the bismuth (and antimony) yield, there is no need for calcium for solubility purposes in the inoculants according to the present invention. In other applications the Ca content could be higher, e.g. from 0.5 to 8% by weight. A high level of Ca may increase slag formation, which is normally not desired. A plurality of inoculants comprise about 0.5 to 3% by weight of Ca in the FeSi alloy.

The FeSi base alloy should comprise up to about 5% by weight of strontium. A Sr amount of 0.2-3% by weight is typically suitable.

Barium may be present in an amount up to about 12% by weight in the FeSi inoculant alloy. Ba is known to give better resistance to fading of the inoculating effect during prolonged holding time of the molten iron after inoculation, and gives better efficiencies over a wider temperature range. Many FeSi alloy inoculants comprise about 0.1-5% by weight of Ba. If barium is used in conjunction with calcium the two may act together to give a greater reduction in chill than an equivalent amount of calcium.

Magnesium may be present in an amount up to about 5% by weight in the FeSi inoculant alloy. However, as Mg normally is added in the nodularisation treatment for the production of ductile iron, the amount of Mg in the inoculant may be low, e.g. up to about 0.1% by weight. Compared to conventional inoculant ferrosilicon alloys containing alloyed bismuth, where magnesium is regarded as a necessary element to stabilise the bismuth containing phases, there is no need for magnesium for stabilisation purposes in the inoculants according to the present invention.

The FeSi base alloy may comprise up to 15% by weight of rare earths metals (RE). RE includes at least Ce, La, Y and/or mischmetal. Mischmetal is an alloy of rare-earth elements, typically comprising approx. 50% Ce and 25% La, with small amounts of Nd and Pr. Additions of RE are frequently used to restore the graphite nodule count and nodularity in ductile iron containing subversive elements, such as Sb, Pb, Bi, Ti etc. In some inoculants the amount of RE is up to 10% by weight. Excessive RE may in some instances lead to chunky graphite formations. Thus, in some applications the amount of RE should be lower, e.g. between 0.1-3% by weight. Preferably the RE is Ce and/or La.

Aluminium has been reported to have a strong effect as a chill reducer. Al is often combined with Ca in a FeSi alloy inoculants for the production of ductile iron. In the present invention the Al content should be up to about 5% by weight, e.g. from 0.1-5%.

Zirconium, manganese and/or titanium are also often present in inoculants. Similar as for the above mentioned elements, the Zr, Mn and Ti play an important role in the nucleation process of the graphite, which is assumed to be formed as a result of heterogeneous nucleation events during solidification. The amount of Zr in the FeSi base alloy may be up to about 10% by weight, e.g. up to 6% by weight. The amount of Mn in the FeSi base alloy may be up to about 10% by weight, e.g. up to 6% by weight. The amount of Ti in the FeSi base alloy may also be up to about 10% by weight, e.g. up to 6% by weight.

Bismuth and antimony are known to have high inoculating power and to provide an increase in the number of nuclei. However, the presence of small amounts of elements like Bi and/or Sb in the melt (also called subversive elements) might reduce nodularity. This negative effect can be neutralized by using Ce or other RE metal. According to the present invention, the amount of particulate $Bi_2S_3$ should be from 0.1 to 15% by weight based on the total amount of the inoculant. In some embodiments the amount of $Bi_2S_3$ is 0.2-10% by weight. A high nodule count is also observed when the inoculant contains 0.5 to 8% by weight, based on the total weight of inoculant, of particulate $Bi_2S_3$.

Introducing $Bi_2S_3$ (and optionally $Bi_2O_3$) together with the FeSi based alloy inoculant is adding a reactant to an already existing system with Mg inclusions floating around in the melt and "free" Mg. The addition of inoculant is not a violent reaction and the Bi yield (Bi/$Bi_2S_3$ (and $Bi_2O_3$) remaining in the melt) is expected to be high. The $Bi_2S_3$ particles should have a small particle size, i.e. micron size (e.g. 1-10 μm), resulting in very quick melting or dissolution of the $Bi_2S_3$ particles when introduced into the cast iron melt. Advantageously, the $Bi_2S_3$ particles are mixed with the particulate FeSi base alloy, and if present, the particulate $Bi_2O_3$, $Sb_2O_3$, $Sb_2S_3$, one or more of $Fe_3O_4$, $Fe_2O_3$, FeO, or a mixture thereof and/or one or more of FeS, $FeS_2$, $Fe_3S_4$, or a mixture thereof, prior to adding the inoculant into the cast iron melt.

The amount of particulate $Bi_2O_3$, if present, should be from 0.1 to 15% by weight based on the total amount of the inoculant. In some embodiments the amount of $Bi_2O_3$ can be 0.1-10% by weight. The amount of $Bi_2O_3$ can also be from about 0.5 to about 3.5% by weight, based on the total weight of inoculant. The particle size of the $Bi_2O_3$ should be similar to the $Bi_2S_3$ particles, i.e. micron size, e.g. 1-10 μm.

Adding Bi in the form of $Bi_2S_3$ particles and $Bi_2O_3$, if present, instead of alloying Bi with the FeSi alloy has several advantages. Bi has poor solubility in ferrosilicon alloys, therefore, the yield of added Bi metal to the molten ferrosilicon is low and thereby the cost of a Bi-containing FeSi alloy inoculant increases. Further, due to the high density of elemental Bi it may be difficult to obtain a homogeneous alloy during casting and solidification. Another difficulty is the volatile nature of Bi metal due to the low melting temperature compared to the other elements in the FeSi based inoculant. Adding Bi as a sulphide and oxide, if present, together with the FeSi base alloy provides an inoculant which is easy to produce with probably lower production costs compared to the traditional alloying process, wherein the amount of Bi is easily controlled and reproducible. Further, as the Bi is added as sulphide, and oxide if present, instead of alloying in the FeSi alloy, it is easy to vary the composition of the inoculant, e.g. for smaller production series. Further, although Bi is known to have a high inoculating power, both the oxygen and the sulphur are also of importance for the performance of the present inoculant, hence, providing another advantage of adding Bi as a sulphide and a oxide.

The amount of particulate $Sb_2O_3$, if present, should be from 0.1 to 15% by weight based on the total amount of the inoculant. In some embodiments the amount of $Sb_2O_3$ can be 0.1-8% by weight. The amount of $Sb_2O_3$ can also be from about 0.5 to about 3.5% by weight, based on the total weight of inoculant. The amount of particulate $Sb_2S_3$, if present, should be from 0.1 to 15% by weight based on the total amount of the inoculant. In some embodiments the amount of $Sb_2S_3$ can be 0.1-8% by weight. The amount of $Sb_2S_3$ can also be from about 0.5 to about 3.5% by weight, based on the total weight of inoculant.

The $Sb_2O_3$ particles and $Sb_2S_3$ particles should have a small particle size, i.e. micron size, e.g. 10-150 μm, resulting in very quick melting and/or dissolution of the $Sb_2O_3$ and/or $Sb_2S_3$ particles when introduced in the cast iron melt.

Adding Sb in the form of $Sb_2O_3$ particles and/or $Sb_2S_3$, instead of alloying Sb with the FeSi alloy, provide several advantages. Although Sb is a powerful inoculant, the oxygen and sulphur are also of importance for the performance of the inoculant. Another advantage is the good reproducibility, and flexibility, of the inoculant composition since the amount and the homogeneity of particulate $Sb_2O_3$ and/or $Sb_2S_3$ in the inoculant are easily controlled. The importance of controlling the amount of inoculants and having a homogenous composition of the inoculant is evident given the fact that antimony is normally added at a ppm level. Adding an inhomogeneous inoculant may result in wrong amounts of inoculating elements in the cast iron. Still another advantage is the more cost effective production of the inoculant compared to methods involving alloying antimony in a FeSi based alloy.

The total amount of one or more of particulate $Fe_3O_4$, $Fe_2O_3$, FeO, or a mixture thereof, if present, should be from 0.1 to 5% by weight based on the total amount of the inoculant. In some embodiments the amount of one or more of $Fe_3O_4$, $Fe_2O_3$, FeO, or a mixture thereof can be 0.5-3% by weight. The amount of one or more of $Fe_3O_4$, $Fe_2O_3$, FeO, or a mixture thereof can also be from about 0.8 to about 2.5% by weight, based on the total weight of inoculant. Commercial iron oxide products for industrial applications, such as in the metallurgy field, might have a composition comprising different types of iron oxide compounds and phases. The main types of iron oxide being $Fe_3O_4$, $Fe_2O_3$, and/or FeO (including other mixed oxide phases of $Fe^{II}$ and $Fe^{III}$; iron(II,III)oxides), all which can be used in the inoculant according to the present invention. Commercial iron oxide products for industrial applications might comprise minor (insignificant) amounts of other metal oxides as impurities.

The total amount of one or more of particulate FeS, $FeS_2$, $Fe_3S_4$, or a mixture thereof, if present, should be from 0.1 to 5% by weight based on the total amount of the inoculant. In some embodiments the amount of one or more of FeS, $FeS_2$, $Fe_3S_4$, or a mixture thereof can be 0.5-3% by weight. The amount of one or more of FeS, $FeS_2$, $Fe_3S_4$, or a mixture thereof can also be from about 0.8 to about 2.5% by weight, based on the total weight of inoculant. Commercial iron sulphide products for industrial applications, such as in the metallurgy field, might have a composition comprising different types of iron sulphide compounds and phases. The main types of iron sulphides being FeS, $FeS_2$ and/or $Fe_3S_4$ (iron(II, III)sulphide; $FeS \cdot Fe_2S_3$), including non-stoichiometric phases of FeS; $Fe_{1+x}S$ (x>0 to 0.1) and $Fe_{1-y}S$ (y>0 to 0.2), all which can be used in the inoculant according to the present invention. A commercial iron sulphide product for industrial applications might comprise minor (insignificant) amounts of other metal sulphides as impurities.

One of the purposes of adding one or more of $Fe_3O_4$, $Fe_2O_3$, FeO, or a mixture thereof and/or one or more of FeS, $FeS_2$, $Fe_3S_4$, or a mixture thereof into the cast iron melt is to deliberately add oxygen and sulphur into the melt, which may contribute to increase the nodule count.

It should be understood that the total amount of the $Bi_2S_3$ particles, and any of the said particulate Bi oxide, Sb oxide/sulphide and/or Fe oxide/sulphide, if present, should be up to about 20% by weight, based on the total weight of the inoculant. It should also be understood that the composition of the FeSi base alloy may vary within the defined ranges, and the skilled person will know that the amounts of the alloying elements add up to 100%. There exists a plurality of conventional FeSi based inoculant alloys, and the skilled person would know how to vary the FeSi base composition based on these. The addition rate of the inoculant according to the present invention to a cast iron melt is typically from about 0.1 to 0.8% by weight. The skilled person would adjust the addition rate depending on the levels of the elements, e.g. an inoculant with high Bi and/or Sb will typically need a lower addition rate.

The present inoculant is produced by providing a particulate FeSi base alloy having the composition as defined herein, and adding to the said particulate base the particulate $Bi_2S_3$, and any particulate $Bi_2O_3$, and/or particulate $Sb_2O_3$, and/or particulate $Sb_2S_3$ and/or one or more of particulate $Fe_3O_4$, $Fe_2O_3$, FeO, or a mixture thereof, and/or one or more of particulate FeS, $FeS_2$, $Fe_3S_4$, or a mixture thereof, if present, to produce the present inoculant. The $Bi_2S_3$ particles, and any of the said particulate Bi oxide, Sb oxide/sulphide and/or Fe oxide/sulphide, if present, may be mechanically/physically mixed with the FeSi base alloy particles. Any suitable mixer for mixing/blending particulate and/or powder materials may be used. The mixing may be performed in the presence of a suitable binder, however it should be noted that the presence of a binder is not required. The $Bi_2S_3$ particles, and any of the said particulate Bi oxide, Sb oxide/sulphide and/or Fe oxide/sulphide, if present, may also be blended with the FeSi base alloy particles, providing a homogenously mixed inoculant. Blending the $Bi_2S_3$ particles, and said additional sulphide/oxide powders, with the FeSi base alloy particles, may form a stable coating on the FeSi base alloy particles. It should however be noted that mixing and/or blending the $Bi_2S_3$ particles, and any other of the said particulate oxides/sulphides, with the particulate FeSi base alloy is not mandatory for achieving the inoculating effect. The particulate FeSi base alloy and $Bi_2S_3$ particles, and any of the said particulate oxides/sulphides, may be added separately but simultaneously to the liquid cast iron. The inoculant may also be added as an in-mould inoculant or simultaneously to casting. The inoculant particles of FeSi alloy, $Bi_2S_3$ particles, and any of the said particulate Bi oxide, Sb oxide/sulphide and/or Fe oxide/sulphide, if present, may also be formed to agglomerates or briquettes according to generally known methods.

The following Examples show that the addition of $Bi_2S_3$ particles together with FeSi base alloy particles results in an increased nodule number density when the inoculant is added to cast iron, compared to an inoculant according to the prior art in WO 99/29911. A higher nodule count allows reducing the amount of inoculant necessary to achieve the desired inoculating effect.

EXAMPLES

All test samples were analysed with respect to the microstructure to determine the nodule density. The microstructure was examined in one tensile bar from each trial according to ASTM E2567-2016. Particle limit was set to >10 μm. The tensile samples were 028 mm cast in standard moulds according to ISO1083-2004, and were cut and prepared according to standard practice for microstructure analysis before evaluating by use of automatic image analysis software. The nodule density (also denoted nodule number density) is the number of nodules (also denoted nodule count) per $mm^2$, abbreviated $N/mm^2$.

The iron oxide used in the following examples, was a commercial magnetite ($Fe_3O_4$) with the specification (supplied by the producer); $Fe_3O_4$>97.0%; $SiO_2$<1.0%. The commercial magnetite product probably included other iron oxide forms, such as $Fe_2O_3$ and FeO. The main impurity in the commercial magnetite was $SiO_2$, as indicated above.

The iron sulphide used in the following examples, was a commercial FeS product. An analysis of the commercial product indicated presence of other iron sulphide compounds/phases in addition to FeS, and normal impurities in insignificant amounts.

Example 1

Two cast iron melts, each of 220 kg, were melted and treated with 1.05 wt-% MgFeSi nodularising alloy based on the weight of the cast irons in a tundish cover treatment ladle. (The composition of the MgFeSi nodularising alloy was 46.2% Si, 5.85% Mg, 1.02% Ca, 0.92% RE, 0.74% Al, balance Fe and incidental impurities in the ordinary amount, where RE (Rare Earth metals) contains approximately 65% Ce and 35% La). 0.9% by weight of steel chips were used as cover. Addition rates for all inoculants were 0.2 wt-% added to each pouring ladle. The MgFeSi treatment temperature was 1500° C. and pouring temperatures were 1396-1330° C. for melt E and 1392-1337° C. for melt F. (Temperatures measured in the treatment ladle before pouring the first pouring ladle and after pouring the last pouring ladle). Holding time from filling the pouring ladles to pouring was 1 minute for all trials.

In some of the tests the inoculant had a base FeSi alloy composition of 74.2 wt % Si, 0.97 wt % Al, 0.78 wt % Ca, 1.55 wt % Ce, the remaining being iron and incidental impurities in the ordinary amount, herein denoted Inoculant A. The Mg treated cast iron melts E and F were inoculated with an inoculant according to the present invention where bismuth sulfide ($Bi_2S_3$) were added to Inoculant A, and mechanically mixed to obtain a homogenous mixture. Different amounts of particulate $Bi_2S_3$ and one of more of bismuth oxide ($Bi_2O_3$) in particulate form, iron sulphide (FeS) in particulate form and/or iron oxide ($Fe_3O_4$) in particulate form were added to Inoculant A, and mechanically mixed to obtain homogenous mixtures of the different inoculant components, according to the present invention.

Melt F was also treated with a lower RE inoculant having a base FeSi alloy composition of 70.1 wt % Si, 0.96 wt % Al, 1.45 wt % Ca, 0.34 wt % Ce and 0.22% La, the remaining being iron and incidental impurities in the ordinary amount (herein denoted Inoculant B), where particulate bismuth sulfide ($Bi_2S_3$) were added to the Inoculant B, and mechanically mixed to obtain a homogenous mixture. Melt F was also treated with an inoculant according to the present invention, which was prepared by mixing particulate Inoculant B with particulate $Bi_2S_3$ and particulate $Bi_2O_3$, see Table 1.

For comparison purposes the same cast iron melts, Melt E and F, were inoculated with Inoculant A to which were added only iron oxide and iron sulphides according to the prior art in WO 99/29911.

Chemical composition for all treatments were within 3.5-3.7% C, 2.3-2.5% Si, 0.29-0.31% Mn, 0.009-0.011% S, 0.04-0.05% Mg.

The added amounts of particulate $Bi_2S_3$, and one of more of particulate $Bi_2O_3$, particulate FeS and/or particulate $Fe_3O_4$ to the FeSi base alloy (Inoculant A or Inoculant B) are shown in Table 1, together with the inoculants according to the prior art. The amounts of $Bi_2S_3$, $Bi_2O_3$, FeS and $Fe_3O_4$ are the percentage of compounds, based on the total weight of the inoculants in all tests.

TABLE 1

Inoculant compositions.

| | Base inoculant | Additions, wt-% FeS | $Fe_3O_4$ | $Bi_2S_3$ | $Bi_2O_3$ | Reference |
|---|---|---|---|---|---|---|
| Melt E | Inoculant A | 1 | 2 | — | — | Prior art |
| | Inoculant A | — | — | 1.2 | — | Inoc A + Bi2S3 |
| | Inoculant A | 1 | 2 | 1.2 | — | Inoc A + Bi2S3/ FeS/Fe3O4 |
| Melt F | Inoculant A | 1 | 2 | — | — | Prior art |
| | Inoculant A | — | — | 0.6 | 0.55 | Inoc A + Bi2S3/ Bi2O3 |
| | Inoculant B | — | — | 1.2 | — | Inoc B + Bi2S3 |
| | Inoculant B | — | — | 0.60 | 0.55 | Inoc B + Bi2S3/ Bi2O3 |

FIG. 1 shows the nodule density in the cast irons from the inoculation trials in Melt E. The results show a very significant trend that $Bi_2S_3$ containing inoculants have a higher nodule density compared to the prior art inoculant.

Figure 2:
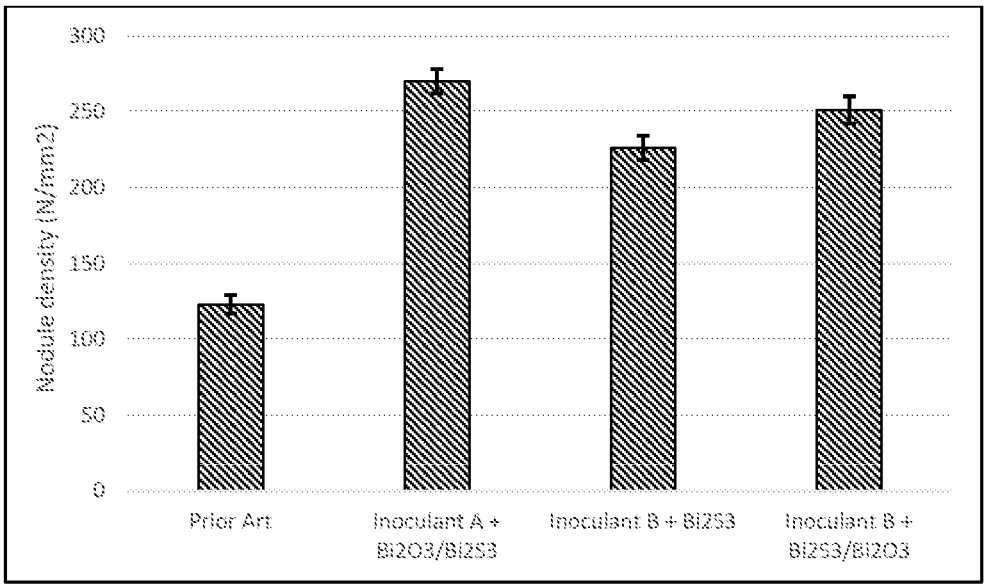
FIG. 2: diagram showing nodule number density (nodule number per $mm^2$, abbreviated $N/mm^2$) in cast iron samples of Melt F in example 1.

FIG. 2 shows the nodule density in the cast irons from the inoculation trials in Melt F. The results show a very significant trend that $Bi_2S_3$, and $Bi_2S_3$+$Bi_2O_3$, containing inoculants, have a higher nodule density compared to the prior art inoculant. The performance of the inoculants was high for both Inoculant A and Inoculant B base inoculants, thus the lower RE inoculant, Inoculant B, did not significantly change the microstructure compared to the higher RE base alloy inoculant; Inoculant A.

Example 2

Two cast iron melts, Melt H and I, each of 275 kg were melted and treated by 1.05 wt-% MgFeSi nodulariser alloy divided on 50% of a MgFeSi alloy having a composition 46.6% Si, 5.82% Mg, 1.09% Ca, 0.53% RE, 0.6% Al, balance Fe and incidental impurities in the ordinary amount, and 50% of a MgFeSi alloy having a composition 46.3% Si, 6.03% Mg, 0.45% Ca, 0.0% RE, 0.59% Al, balance Fe and incidental impurities in the ordinary amount, in a tundish cover ladle. 0.7% by weight steel chips were used as cover. Addition rate for all inoculants were 0.2% by weight added to each pouring ladle. The MgFeSi treatment temperature was 1500° C. and pouring temperatures were 1375-1357° C. for Melt H and 1366-1323° C. for Melt I. Holding time from filling the pouring ladles to pouring was 1 minute for all trials.

In both Melt H and Melt I tests the inoculant had a base FeSi alloy composition the same as Inoculant A, as described in Example 1. The base FeSi alloy particles (Inoculant A) were coated by particulate $Bi_2S_3$ (Melt H), and by particulate $Bi_2S_3$ and particulate $Sb_2O_3$ (Melt I) by mechanically mixing to obtain a homogenous mixture. Chemical composition for all treatments were within 3.5-3.7% C, 2.3-2.5% Si, 0.29-0.31% Mn, 0.009-0.011% S, 0.04-0.05% Mg.

The added amounts of particulate $Bi_2S_3$, and particulate $Sb_2O_3$, to the FeSi base alloy (Inoculant A) are shown in Table 2, together with the inoculants according to the prior art. The amounts of $Bi_2S_3$, $Sb_2O_3$, FeS and $Fe_3O_4$ are the percentage of compounds, based on the total weight of the inoculants in all tests.

TABLE 2

Inoculant compositions.

| | Base inoculant | Additions, wt-% FeS | $Fe_3O_4$ | $Bi_2S_3$ | $Sb_2O_3$ | Reference |
|---|---|---|---|---|---|---|
| Melt H | Inoculant A | 1.00 | 2.00 | — | Prior art | |
| | Inoculant A | — | — | 0.74 | — | Inoc A + 0.74Bi2S3 |
| | Inoculant A | — | — | 1.23 | — | Inoc A + 1.23Bi2S3 |
| | Inoculant A | — | — | 1.72 | — | Inoc A + 1.72Bi2S3 |
| | Inoculant A | — | — | 5.57 | — | Inoc A + 5.57Bi2S3 |
| | Inoculant A | — | — | 12.30 | — | Inoc A + 12.3Bi2S3 |
| Melt I | Inoculant A | 1 | 2 | — | — | Prior art |
| | Inoculant A | — | — | 0.62 | 0.6 | Inoc A + Bi2S3/Sb2O3 |

Figure 3:
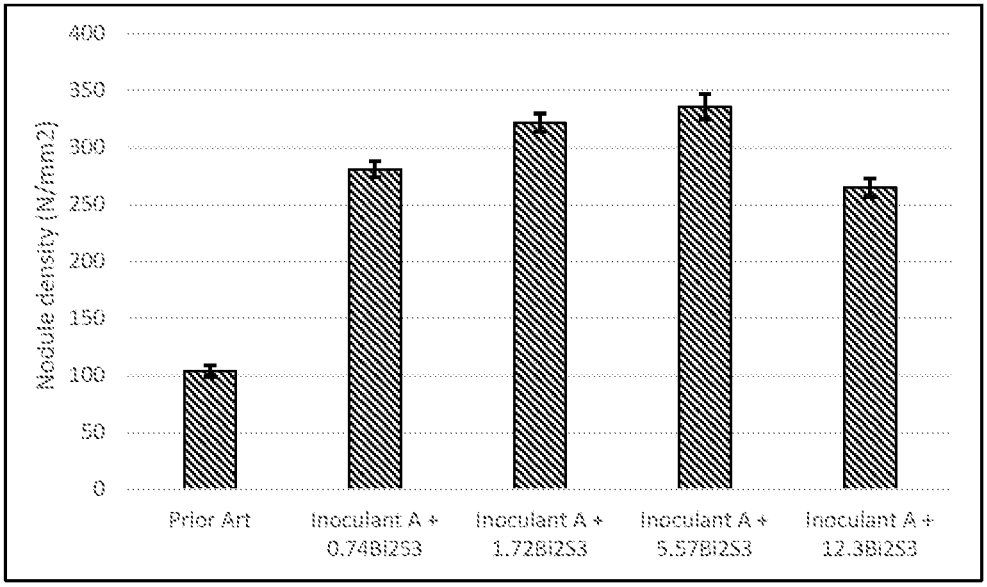
FIG. 3: diagram showing nodule number density (nodule number per $mm^2$, abbreviated $N/mm^2$) in cast iron samples of Melt H in example 2.

FIG. 3 shows the nodule density in the cast irons from the inoculation trials in Melt H. The results show a very significant trend that $Bi_2S_3$ containing inoculants have a much higher nodule density compared to the prior art inoculant. The trial with varying amounts of Bi sulphide shows a significant increased nodule density over the whole range of different amounts of particulate $Bi_2S_3$ coated on the Inoculant A.

Figure 4:
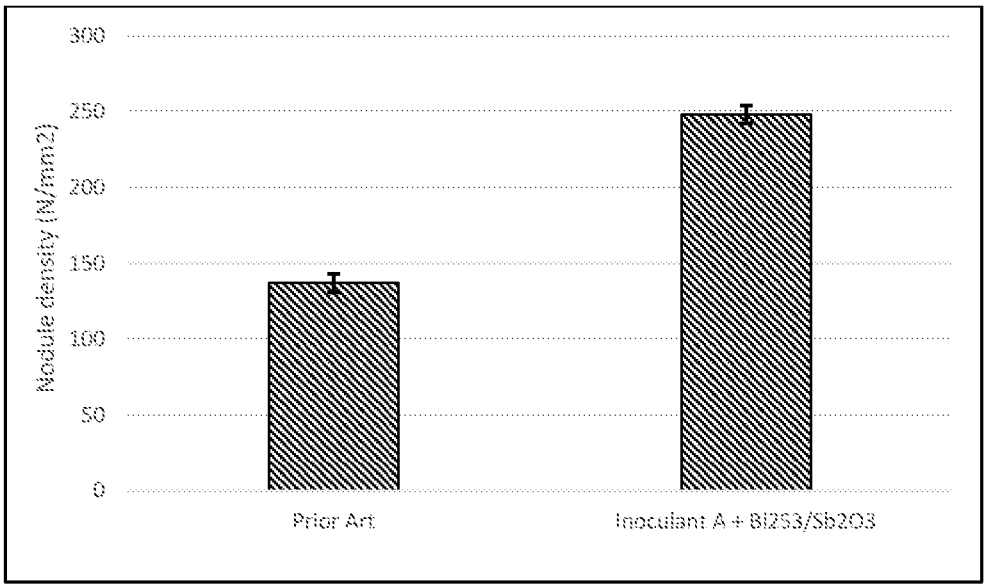
FIG. 4: diagram showing nodule number density (nodule number per $mm^2$, abbreviated $N/mm^2$) in cast iron samples of Melt I in example 2.

FIG. 4 shows the nodule density in the cast irons from the inoculation trials in Melt I. The results show a very significant trend that $Bi_2S_3$+$Sb_2O_3$ containing inoculant have a higher nodule density compared to the prior art inoculant.

Example 3

A 275 kg melt was produced and treated by 1.0% RE free MgFeSi nodulariser alloy or the composition, in wt-%; Si: 47, Mg: 6.12, Ca: 1.86, RE: 0.0, Al: 0.54, balance Fe and incidental impurities. 0.7% by weight steel chips was used as cover.

The $Bi_2S_3$ coated inoculants was based on Inoculant C with composition (in wt-%); Si: 77.3, Al: 1.07, Ca: 0.92, La: 2.2, balance Fe and incidental impurities. Inoculant A had the same composition as in Example 1.

The inoculants were made by adding particulate $Bi_2S_3$, $Fe_3O_4$ and FeS to the base alloys in the amount shown in Table 3 below, and mechanically mixed to obtain a homogenous mixture. Addition rate for inoculants were 0.2% added to each pouring ladle. The MgFeSi treatment temperature was 1500° C. and pouring temperatures were between 1388 and 1370° C. Holding time from filling the pouring ladle to pouring was 1 minute.

Chemical composition for the treatments were within 3.5-3.7% C, 2.4-2.5% Si, 0.29-0.30% Mn, 0.007-0.011% S, 0.040-0.043% Mg.

The added amounts of particulate $Bi_2S_3$ to the FeSi base alloy (Inoculant C) is shown in Table 3, together with the inoculants according to the prior art. The amounts of $Bi_2S_3$, FeS and $Fe_3O_4$ are the percentage of compounds, based on the total weight of the inoculants in all tests.

TABLE 3

Inoculant composition

| | | Additions, wt-% | | | |
|---|---|---|---|---|---|
| | Base inoculant | FeS | $Fe_3O_4$ | $Bi_2S_3$ | Reference |
| Melt Y | Inoculant C | — | — | 1.80 | Inoc C + Bi2S3 |
| | Inoculant A | 1.00 | 2.00 | — | Prior art |

Figure 5:
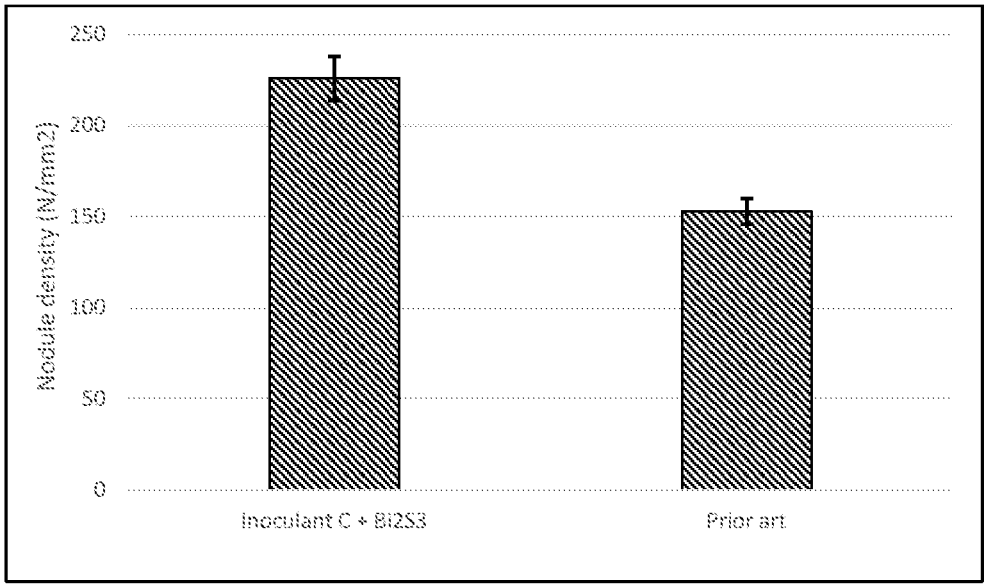
FIG. 5: diagram showing nodule number density (nodule number per $mm^2$, abbreviated $N/mm^2$) in cast iron samples of Melt Y in example 3.

The nodule density in the cast irons from the inoculation trials in Melt Y are shown in FIG. 5. Analysis of the microstructure showed that the inoculant according to the present invention (Inoc C+Bi2S3) had significantly higher nodule density, compared to the prior art inoculant.

Example 4

Two cast iron melts, Melt X and Y, each of 275 kg were melted and treated by 1.20-1.25 wt-% MgFeSi nodulariser in a tundish cover ladle. The MgFeSi nodularizing alloy had the following composition by weight: 4.33 wt % Mg, 0.69 wt % Ca, 0.44 wt % RE, 0.44 wt % Al, 46. wt % Si, the balance being iron and incidental impurities in the ordinary amount. 0.7% by weight steel chips were used as cover. Addition rate for all inoculants were 0.2% by weight added to each pouring ladle. The nodulariser treatment temperature was 1500° C. and the pouring temperatures were 1398-1379° C. for melt X and 1389-1386° C. for melt Y. Holding time from filling the pouring ladles to pouring was 1 minute for all trials.

In Melt X test, the inoculant had a base FeSi alloy composition of 68.2 wt % Si; 0.95 wt % Ca; 0.94 wt % Ba; 0.93 wt % Al (herein denoted Inoculant D). The base FeSi alloy particles (Inoculant D) were coated by particulate $Bi_2S_3$. In Melt Y tests the inoculant had a base FeSi alloy composition the same as Inoculant A, as described in Example 1. The base FeSi alloy particles (Inoculant A) were coated with particulate $Bi_2S_3$ and particulate $Sb_2S_3$ by mechanically mixing to obtain a homogenous mixture.

Chemical composition for all treatments were within 3.55-3.61% C, 2.3-2.5% Si, 0.29-0.31% Mn, 0.009-0.012 S, 0.04-0.05% Mg.

The added amounts of particulate $Bi_2S_3$, and particulate $Sb_2S_3$, to the FeSi base alloy Inoculant A and of particulate $Bi_2S_3$ to the FeSi base alloy Inoculant D are shown in Table 4, together with the inoculants according to the prior art. The amounts of $Bi_2S_3$, $Sb_2S_3$, FeS and $Fe_3O_4$ are based on the total weight of the inoculants in all tests.

TABLE 4

Inoculant compositions.

| | Base | Additions, wt-% | | | | |
|---|---|---|---|---|---|---|
| | inoculant | FeS | $Fe_3O_4$ | $Bi_2S_3$ | $Sb_2S_3$ | Reference |
| Melt | Inoculant A | 1 | 2 | — | — | Prior art |
| X | Inoculant D | — | — | 2.46 | — | Inoculant D + Bi2S3 |
| Melt | Inoculant A | 1 | 2 | — | — | Prior art |
| Y | Inoculant A | — | — | 1.23 | 1.39 | Inoculant A + Bi2S3/Sb2S3 |

Figure 6:
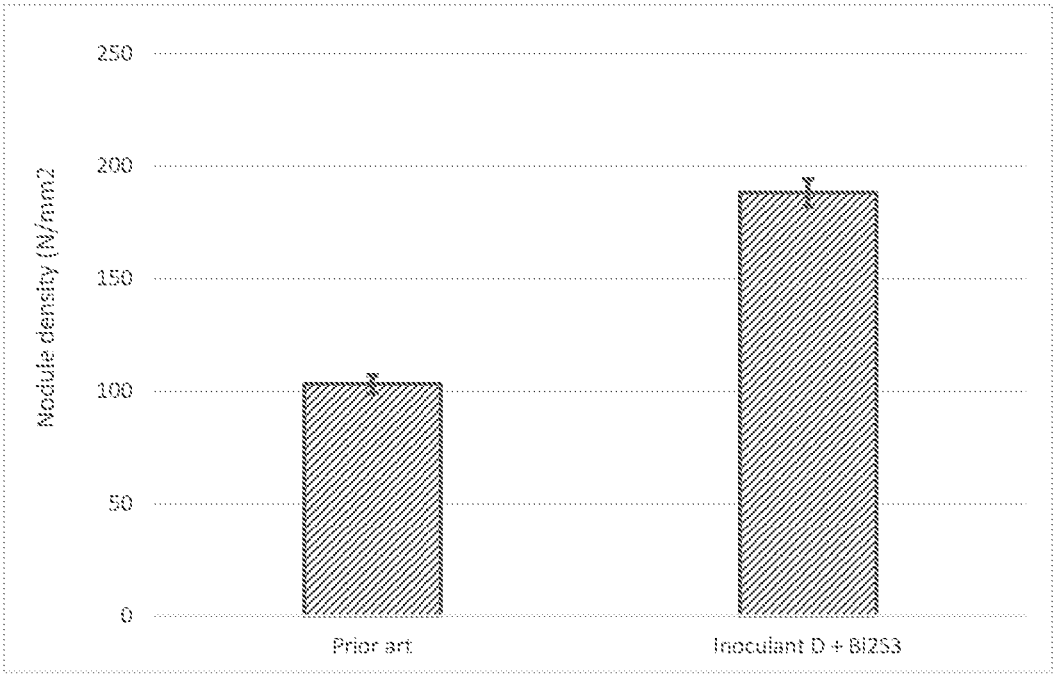
FIG. 6: diagram showing nodule number density (nodule number per $mm^2$, abbreviated $N/mm^2$) in cast iron samples of Melt X in example 4.

FIG. 6 shows the nodule density in the cast irons from the inoculation trials in Melt X. The results show a very significant trend that $Bi_2S_3$ containing inoculants have a much higher nodule density compared to the prior art inoculant.

Figure 7:
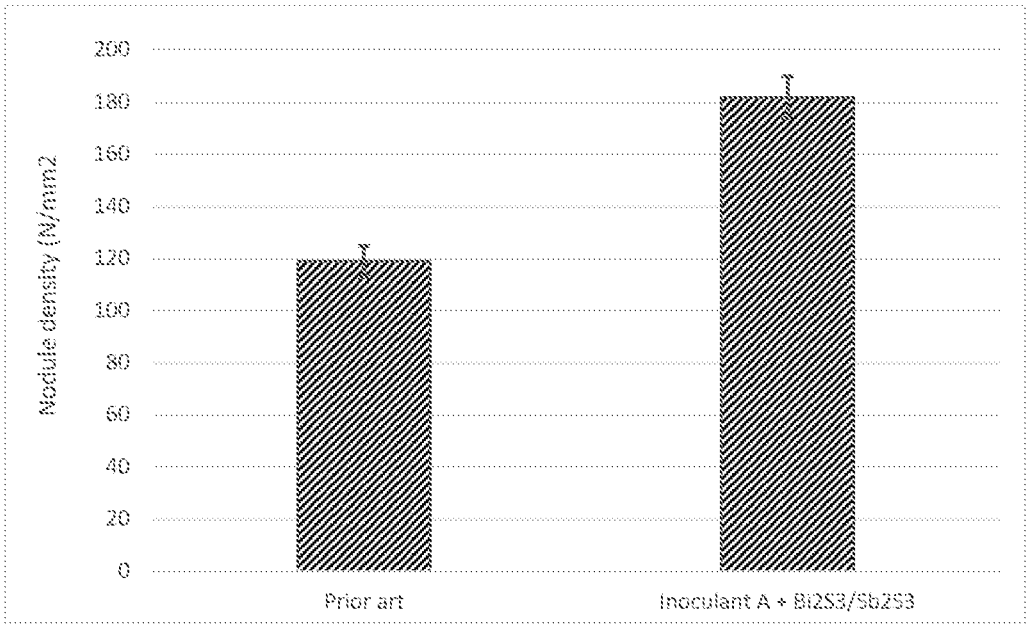
FIG. 7: diagram showing nodule number density (nodule number per $mm^2$, abbreviated $N/mm^2$) in cast iron samples of Melt Y in example 4.

FIG. 7 shows the nodule density in the cast irons from the inoculation trials in Melt Y. The results show a very significant trend that $Bi_2S_3$+$Sb_2S_3$ containing inoculant have a higher nodule density compared to the prior art inoculant.

Example 5

A 275 kg melt was produced and treated by 1.20-1.25 wt-% MgFeSi nodulariser in a tundish cover ladle. The MgFeSi nodularizing alloy had the following composition by weight: 4.33 wt % Mg, 0.69 wt % Ca, 0.44 wt % RE, 0.44 wt % Al, 46 wt % Si, the balance being iron and incidental impurities in the ordinary amount. 0.7% by weight steel chips were used as cover. Addition rate for all inoculants were 0.2% by weight added to each pouring ladle. The nodulariser treatment temperature was 1500° C. and the pouring temperatures were 1373-1368° C. Holding time from filling the pouring ladles to pouring was 1 minute for all trials. The tensile samples were 028 mm cast in standard moulds and were cut and prepared according to standard practice before evaluating by use of automatic image analysis software.

The inoculant had a base FeSi alloy composition 74.2 wt % Si, 0.97 wt % Al, 0.78 wt % Ca, 1.55 wt % Ce, the remaining being iron and incidental impurities in the ordinary amount, herein denoted Inoculant A. A mix of particulate bismuth oxide, bismuth sulphide, antimony oxide and antimony sulphide of the composition indicated in Table 5 was added to the base FeSi alloy particles (Inoculant A) and by mechanically mixing, a homogeneous mixture was obtained.

The final iron had a chemical composition of 3.74 wt % C, 2.37 wt % Si, 0.20 wt % Mn, 0.011 wt % S, 0.037 wt % Mg. All analyses were within the limits set before the trial.

The added amounts of particulate $Bi_2S_3$, particulate $Bi_2O_3$, particulate $Sb_2O_3$ and particulate $Sb_2S_3$, to the FeSi base alloy Inoculant A are shown in Table 5, together with the inoculant according to the prior art. The amounts of $Bi_2S_3$, $Bi_2O_3$, $Sb_2S_3$, $Sb_2O_3$, FeS and $Fe_3O_4$ are based on the total weight of the inoculants in all tests.

TABLE 5

| Inoculant compositions. | | | | | | | |
|---|---|---|---|---|---|---|---|
| Base | Additions, wt-% | | | | | | |
| inoculant | FeS | $Fe_3O_4$ | $Bi_2S_3$ | $Sb_2S_3$ | $Bi_2O_3$ | $Sb_2O_3$ | Reference |
| Inoculant A | 1 | 2 | — | — | — | — | Prior art |
| Inoculant A | — | — | 0.5 | 0.5 | 0.5 | 0.5 | Inoculant A + comb 1 |
| Inoculant A | — | — | 4 | 4 | 4 | 4 | Inoculant A + comb 2 |

Figure 8:
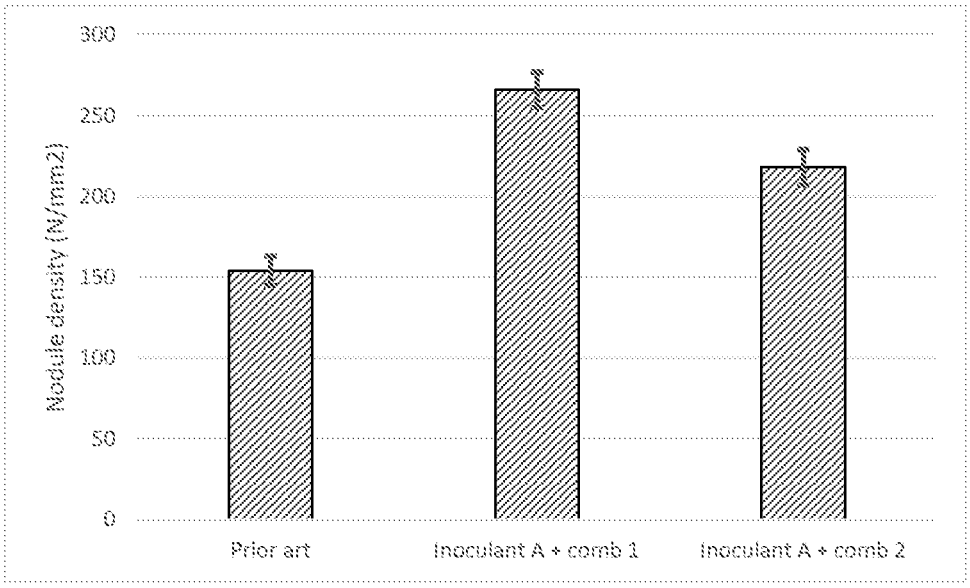
FIG. 8: diagram showing nodule number density (nodule number per $mm^2$, abbreviated $N/mm^2$) in cast iron samples of in example 5.

FIG. 8 shows the nodule density in the cast irons from the inoculation trials according to Table 5. The results show a very significant trend that the inoculants according to the present invention; FeSi base alloy containing particulate $Bi_2S_3$, $Bi_2O_3$, $Sb_2S_3$ and $Sb_2O_3$, have a much higher nodule density compared to the prior art inoculant. The thermal analysis (not shown herein) showed a clear trend that TElow is significantly higher in samples inoculated with $Bi_2S_3$, $Bi_2O_3$,$Sb_2S_3$, $Sb_2O_3$ containing FeSi base alloy inoculants compared to the prior art inoculant.

Having described different embodiments of the invention it will be apparent to those skilled in the art that other embodiments incorporating the concepts may be used. These and other examples of the invention illustrated above and in the accompanying drawings are intended by way of example only and the actual scope of the invention is to be determined from the following claims.

The invention claimed is:

1. An inoculant for the manufacture of cast iron with spheroidal graphite, said inoculant comprises:

a particulate ferrosilicon alloy consisting of:

between 40 and 80% by weight of Si;

0.02-8% by weight of Ca;

0-5% by weight of Sr;

0-12% by weight of Ba;

0-15% by weight of rare earth metal;

0.05-5% by weight of Al;

0-10% by weight of Mn;

0-10% by weight of Ti;

0-10 by weight of Zr;

the balance being Fe and unavoidable impurities, wherein said inoculant additionally contains, by weight, based on the total weight of inoculant:

0.1 to 15% of particulate $Bi_2S_3$, and optionally between 0.1 and 15% of particulate $Bi_2O_3$, and/or between 0.1 and 15% of particulate $Sb_2O_3$, and/or between 0.1 and 15% of particulate $Sb_2S_3$, and/or between 0.1 and 5% of one or more of particulate $Fe_3O_4$, $Fe_2O_3$, FeO, or a mixture thereof, and/or between 0.1 and 5% of one or more of particulate FeS, $FeS_2$, $Fe_3S_4$, or a mixture thereof.

2. The inoculant according to claim 1, wherein the ferrosilicon alloy comprises between 45 and 60% by weight of Si.

3. The inoculant according to claim 1, wherein the ferrosilicon alloy comprises between 60 and 80% by weight of Si.

4. The inoculant according to claim 1, wherein the rare earth metals include Ce, La, Y and/or mischmetal.

5. The inoculant according to claim 1, wherein the inoculant comprises between 0.5 and 10% by weight of particulate $Bi_2S_3$.

6. The inoculant according to claim 1, wherein the inoculant comprises between 0.1 and 10% of particulate $Bi_2O_3$.

7. The inoculant according to claim 1, wherein the inoculant comprises between 0.1 and 8% of particulate $Sb_2O_3$.

8. The inoculant according to claim 1, wherein the inoculant comprises between 0.5 and 3% of one or more of particulate $Fe_3O_4$, $Fe_2O_3$, FeO, or a mixture thereof, and/or between 0.5 and 3% of one or more of particulate FeS, $FeS_2$, $Fe_3S_4$, or a mixture thereof.

9. The inoculant according to claim 1, wherein the total amount of the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof is up to 20% by weight, based on the total weight of the inoculant.

10. The inoculant according to claim 1, wherein the inoculant is in the form of a blend or a physical mixture of the particulate ferrosilicon alloy and the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof.

11. The inoculant according claim 1, wherein the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof, and/or one or more of particulate FeS, $FeS_2$, $Fe_3S_4$, or a mixture thereof, is/are present as coating compounds on the particulate ferrosilicon based alloy.

12. The inoculant according to claim 1, wherein the inoculant is in the form of agglomerates made from a mixture of the particulate ferrosilicon alloy and the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof.

13. The inoculant according to claim 1, wherein the inoculant is in the form of briquettes made from a mixture of the particulate ferrosilicon alloy and the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof.

14. The inoculant according to claim 1, wherein the particulate ferrosilicon based alloy and the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof, are added separately but simultaneously to liquid cast iron.

15. An inoculant for the manufacture of cast iron with spheroidal graphite, said inoculant comprises:

a particulate ferrosilicon alloy consisting of:

between 40 and 80% by weight of Si;

0.02-8% by weight of Ca;

0-5% by weight of Sr;

0-12% by weight of Ba;

0-15% by weight of rare earth metal;

0-5% by weight of Mg;

0.05-5% by weight of Al;

0-10% by weight of Mn;

0-10% by weight of Ti;

0-10 by weight of Zr;

the balance being Fe and unavoidable impurities, wherein said inoculant additionally contains, by weight, based on the total weight of inoculant:

0.1 to 15% of particulate $Bi_2S_3$, and optionally between 0.1 and 15% of particulate $Bi_2O_3$, and/or between 0.1 and 15% of particulate $Sb_2O_3$, and/or between 0.1 and 5% of one or more of particulate $Fe_3O_4$, $Fe_2O_3$, FeO, or a mixture thereof, and/or between 0.1 and 5% of one or more of particulate FeS, $FeS_2$, $Fe_3S_4$, or a mixture thereof, wherein the inoculant further comprises between 0.1 and 8% of particulate $Sb_2S_3$.

16. A method for producing an inoculant according to claim 1, the method comprises:

providing a particulate ferrosilicon alloy consisting of:

between 40 and 80% by weight of Si;

0.02-8% by weight of Ca;

0-5% by weight of Sr;

0-12% by weight of Ba;

0-15% by weight of rare earth metal;

0.05-5% by weight of Al;

0-10% by weight of Mn;

0-10% by weight of Ti;

0-10 by weight of Zr;

the balance being Fe and unavoidable impurities, and adding to said particulate ferrosilicon alloy, by weight, based on the total weight of inoculant:

0.1 to 15% of particulate $Bi_2S_3$, and optionally between 0.1 and 15% of particulate $Bi_2O_3$, and/or between 0.1 and 15% of particulate $Sb_2O_3$, and/or between 0.1 and 15% of particulate $Sb_2S_3$, and/or between 0.1 and 5% of one or more of particulate $Fe_3O_4$, $Fe_2O_3$, FeO, or a mixture thereof, and/or between 0.1 and 5% of one or more of particulate FeS, $FeS_2$, $Fe_3S_4$, or a mixture thereof, to produce said inoculant.

17. The method according to claim 16, wherein the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof, if present, are mixed or blended with the particulate base alloy.

18. The method according to claim 17, wherein the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof, if present, are mixed before being mixed with the particulate base alloy.

19. A method for manufacturing cast iron with spheroidal graphite comprising adding the inoculant according to claim 1 to the cast iron melt prior to casting, or as an in-mould inoculant.

20. The method according to claim 19, wherein the particulate ferrosilicon based alloy and the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof, are added as a mechanical mixture or a blend to the cast iron melt.

21. The method according to claim 19, wherein the particulate ferrosilicon based alloy and the particulate $Bi_2S_3$, and the optional particulate $Bi_2O_3$, and/or particulate $Sb_2O_3$, and/or particulate $Sb_2S_3$, and/or one or more of particulate $Fe_3O_4$, $Fe_2O_3$, FeO, or a mixture thereof and/or one or more of particulate FeS, $FeS_2$, $Fe_3S_4$, or a mixture thereof, are added separately but simultaneously to the cast iron melt.

* * * * *